US006301989B1

(12) United States Patent
Brown et al.

(10) Patent No.: US 6,301,989 B1
(45) Date of Patent: Oct. 16, 2001

(54) MEDICAL IMAGING INSTRUMENT POSITIONING DEVICE

(75) Inventors: Damon Brown, Coralville; Amy Anderegg, Iowa City, both of IA (US)

(73) Assignee: CIVCO Medical Instruments, Inc., Kalona, IA (US)

( * ) Notice: Subject to any disclaimer, the term of this patent is extended or adjusted under 35 U.S.C. 154(b) by 0 days.

(21) Appl. No.: 09/409,460

(22) Filed: Sep. 30, 1999

(51) Int. Cl.[7] ..... G05G 11/00
(52) U.S. Cl. ..... 74/490.08
(58) Field of Search ..... 74/490.08

(56) References Cited

U.S. PATENT DOCUMENTS 4,006,645 * 2/1977 Newell ..... 74/479
4,306,464 * 12/1981 Mosher ..... 74/479
5,078,140 * 1/1992 Kwoh ..... 128/653.1
5,961,527 10/1999 Whitmore, III et al. .

* cited by examiner

*Primary Examiner*—Dirk Wright
(74) *Attorney, Agent, or Firm*—Merchant & Gould P.C.

(57) ABSTRACT

A positioning apparatus for adjusting the position of medical imaging instruments, such as ultrasound probes, is disclosed. The preferred implementation of the apparatus includes controls for translational movement along three axes; and controls for rotational movement around three axes. In certain implementations, the rotational movement is around a point coincident with the area of image capture.

18 Claims, 13 Drawing Sheets

MEDICAL IMAGING INSTRUMENT POSITIONING DEVICE

FIELD OF THE INVENTION

The present invention relates to an apparatus for positioning a medical imaging instrument. More particularly, the invention relates to an apparatus for adjusting the position of a medical imaging instrument in a number of rotational and translational axes.

BACKGROUND

Medical imaging instruments, such as ultrasound probes, are frequently used by doctors and other medical professionals to conduct non-invasive examination of humans and animals. Imaging instruments, such as ultrasound probes, can be effectively used to examine internal tissue that is not readily examined using normal visual and tactile examination. Kidney stones, tumors, cysts, etc. are all amenable to examination using these medical imaging instruments. In addition, medical imaging instruments are well suited to examination of a growing fetus and to determination of the health of the fetus and to making medical diagnosis' to improve the fetus' health.

Traditionally, the position of many medical imaging instruments, including ultrasound probes, has often been controlled by having the medical practitioner hold the imaging instrument in one or both of his or her hands. In this manner, the medical practitioner manually guides the instrument. Such methods are suitable for many medical procedures, but also pose significant shortcomings in other procedures. One problem associated with manually holding the probe is that the probe can fully occupy one hand of the medical practitioner, thereby making it more difficult to perform ancillary medical procedures, such as removal of a biopsy sample, or even the taking of notes or manipulating the controls of the imaging instrument. Another significant problem associated with holding the probe is that it can be difficult to hold the probe steady, and thus it is difficult to "fine tune" the probe adn direct the imaging field to precise locations in a patient. This fine tuning of the probe location can be particularly important when very localized tissue sampling or medical procedures are being performed, such as during surgical procedures.

In order to address this problem, imaging instrument holding devices have been developed. Unfortunately, existing devices are limited in their effectiveness. For example, Ota et al. have patented a three-dimensional medical locating apparatus (U.S. Pat. No. 5,257,998). Unfortunately, the Ota apparatus is limited to positioning of the instrument in a spherical region about a target point within a patient. Similarly, Winston Barzell and Willet Whitmore of Sarasota, Fla. have developed an imaging positioning system that provides adjustment of an imaging instrument. Unfortunately Barzell and Whitmore's device does not provide for easy and intuitive positioning of an imaging instrument.

SUMMARY OF THE INVENTION

The present invention is directed to a positioning apparatus for adjusting the position of medical imaging instruments, such as ultrasound probes. The preferred implementation of the apparatus includes controls for translational movement along three axes; and controls for rotational movement around three axes. In certain implementations, the rotational movement is around a point coincident with the area of image capture.

In certain embodiments, each of the translational adjustments and rotational adjustments may be made independent of one another. Therefore, translational adjustments in the X-axis can be made without making translational adjustments in the Y-axis or Z-axis. Similarly, translational adjustments can preferably be made in the Y-axis without changing the position of the medical imaging instrument along the X-axis or Z-axis. Likewise, translational adjustments can preferably be made in the Z-axis without altering the position of the medical imaging instrument along the X-axis or Y-axis.

The apparatus provides for rotational positioning of an imaging instrument around one or more rotational axes, and is preferably constructed and arranged such that each rotational axis is independently controllable from the other rotational axes. In certain embodiments of the invention the apparatus preferably provides rotational adjustments around three axes such that at least one axis of the axes of rotational adjustment is through the imaging field of the instrument. Therefore, rotational adjustments of the imaging instrument around the X-axis can preferably be made without altering the position of the imaging instrument around the Y-axis or Z-axis. Similarly, rotation around the Y-axis and Z-axis should preferably be made without alteration of the position of the imaging instrument around the other rotational axes.

The imaging instrument may have an approximate imaging origin and an approximate apparatus origin. The imaging origin corresponds to the source of the image, such as the actual ultrasound transducer in an ultrasound probe, and is preferably proximate the center of the sensor (or sensors) of the imaging instrument. The apparatus origin corresponds approximately to the point at which the imaging instrument is connected to the apparatus, or to the approximate center of mass of the imaging instrument. The apparatus for adjusting the position of the imaging instrument preferably permits the rotational movement of the imaging instrument around at least one axis proximate the imaging origin.

In certain embodiments, the apparatus permits the rotational movement of the imaging instrument around at least two axes located proximate the imaging origin, and in yet other embodiments the apparatus permits the rotational movement of the imaging instrument around three axes located proximate the imaging origin. Also, in certain embodiments, the adjustment apparatus permits the rotational adjustment of the imaging instrument around at least two axes that are positioned intermediate the imaging origin and the apparatus origin.

The above summary of the present invention is not intended to describe each discussed embodiment of the present invention. This is the purpose of the figures and the detailed description which follow.

Figure 1:
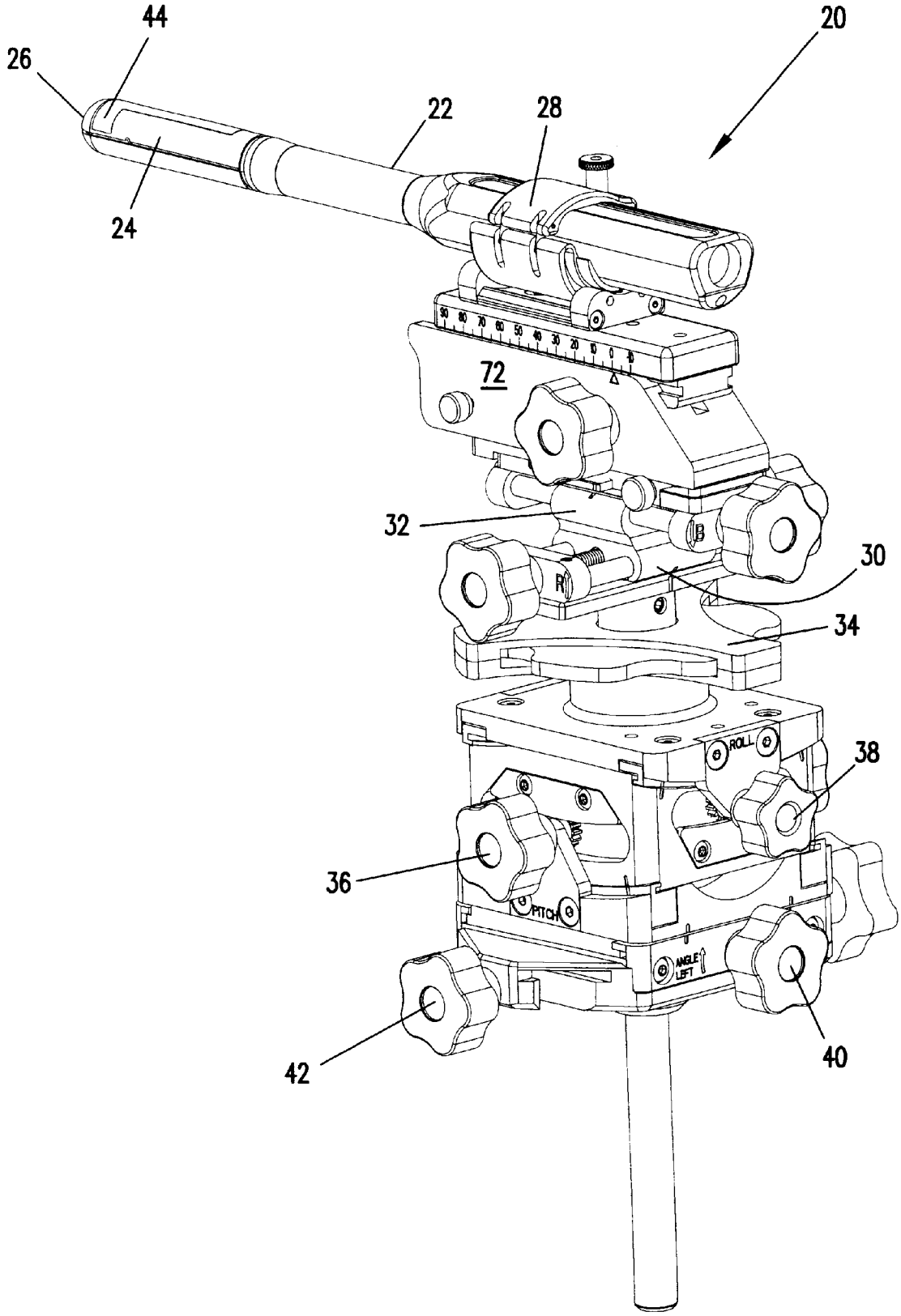
FIG. 1 is a perspective view of a medical imaging instrument positioning device constructed and arranged in accordance with the present invention.

While the invention is susceptible to various modifications and alternative forms, specifics thereof have been shown by way of example and drawings, and will be described in detail. It should be understood, however, that the invention is not limited to the particular embodiments described. On the contrary, the intention is to cover modifications, equivalents, and alternatives falling within the spirit and scope of the invention as defined by the appended claims.

DETAILED DESCRIPTION OF THE INVENTION

The present invention has been described with reference to several particular implementations. In reference to FIG. 1, a medical device positioning apparatus 20 is shown constructed and arranged in accordance with an implementation of the invention. Apparatus 20 is used to hold and position a medical instrument, such as an ultrasound imaging instrument 22. A coordinate representation 21 of the X, Y and Z axes is shown in FIG. 2 to provide a reference for the orientation of the apparatus 20 as referred to in FIG. 1. In addition, coordinate representation 21 shows the rotational X-axis (pitch), rotational Y-axis (roll), and rotational Z-axis (yaw).

As used herein, the X-axis, Y-axis, and Z-axis are all defined to identify the three-dimensional space surrounding positioning apparatus 20, imaging instrument 22, and a patient (not shown). The X-axis corresponds to coordinates either to the left or right of the patient, the Y-axis corresponds to coordinates either toward (into) or away (out from) the patient, and the Z-axis corresponds to up and down (elevation) relative to the patient. These axes are used to define orientation and movement, and are not necessarily used to define a specific origin or locus. Thus, unless explicitly noted, when reference is made to rotation around the "X-axis", such rotation can mean rotation around the X-axis as shown in FIG. 2, which has a locus at the tip of the instrument 22, or rotation around another line parallel to the particular X-axis shown in FIG. 2. Thus, an "X-axis" of rotation defines rotation around the X-axis shown in FIG. 2 or around another line parallel to that axis shown in FIG. 2. Similarly, the Y-axis refers to the Y-axis shown in FIG. 2 or another line parallel to that axis. Likewise, the Z-axis refers to the Z-axis shown in FIG. 2 or another line parallel to that axis.

In reference again to FIG. 1, imaging instrument 22 includes a probe 24 having a tip 26. A target region (not shown) of a patient is positioned in front of or near tip 26 during examination. Tip 26 is the source of ultrasonic sound waves used to conduct an ultrasonic examination of the patient, and is thus positioned at the origin of ultrasound images generated by imaging instrument 22.

In the embodiment depicted, instrument 22 is secured to positioning apparatus 20 by an imaging instrument attachment bracket 28. Bracket 28 is useful in securing the imaging instrument 22 and is preferably removable to accommodate different imaging instruments 22. In various embodiments of the invention, different brackets may be used. Other attachment means and devices may also be used to secure the imaging instrument 22 in place, such as clamps, slots, and hook and loop fasteners. In certain embodiments, the imaging instrument is integrally formed with the positioning apparatus 20, or is integrally formed to a removable portion of the apparatus 20. Thus, the imaging instrument 22 may be secured to the apparatus 20 using one or more of many different configurations and attachment means. In addition, apparatus 20 is preferably manufactured in a manner such that different types of imaging instruments may be used with the same positioning apparatus 20 in order to account for varying functions and configurations of imaging instruments that are available.

In the embodiment depicted, apparatus 20 allows translational movement of the imaging instrument 22 along the X-, Y- and Z-axes, and rotational movement around the X-, Y-, and Z-axes. Translational movement along the X-axis is provided by X-axis translational mechanism 30; translational movement along the Y-axis is provided by Y-axis translational mechanism 32; and translational movement along the Z-axis is provided by Z-axis translational mechanism 34. Rotation around the X-axis ("pitch") is provided by X-axis rotational mechanism 36, rotation around the Y-axis ("roll") is provided by Y-axis rotational mechanism 38, and rotation around the Z-axis ("yaw") is provided by Z-axis rotational mechanism 40. The apparatus 20 can be secured to a table or stand by way of an attachment base 42.

Positioning apparatus 20 allows for adjustment of the position of imaging instrument 22, and preferably permits rotational movement of the imaging instrument around at least one axis proximate imaging origin 44. Positioning apparatus 20 includes, various components that provide adjustment of the position of the imaging instrument, and particularly tip 26 of imaging instrument 22. Positioning apparatus 20 allows adjustment of the imaging instrument 22 in a manner that is easily comprehended and mastered by the medical practitioner. The apparatus 22 allows the practitioner to make numerous precise and different modifications of position of the instrument 22 with a minimal of thought and activity. In the embodiment depicted, the apparatus 20 includes components permitting the translational movement of the instrument 20 along up to three different axes, and the rotational movement of the instrument around up to three different axis.

Figure 3A:
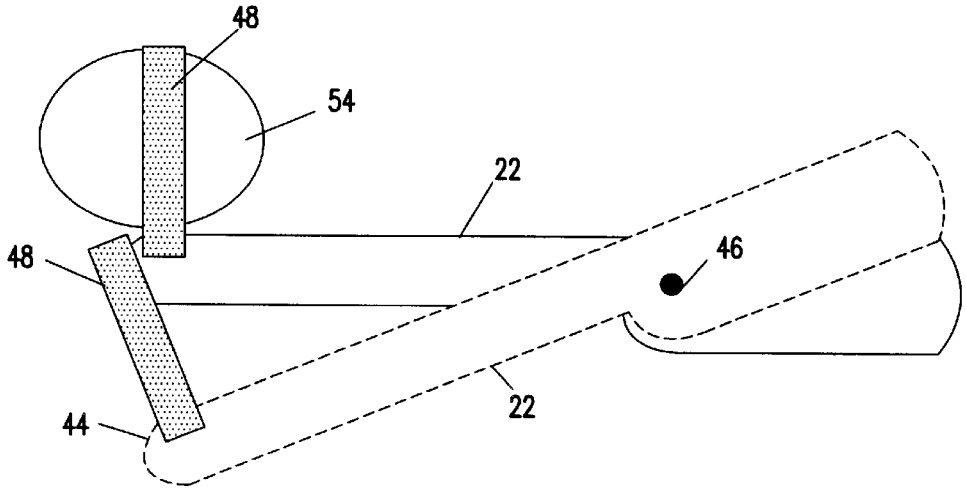
FIG. 3A is a simplified side plan view of an imaging instrument, showing rotation of the imaging sensor around an axis distal from the origin of the instrument image field.
Figure 3B:
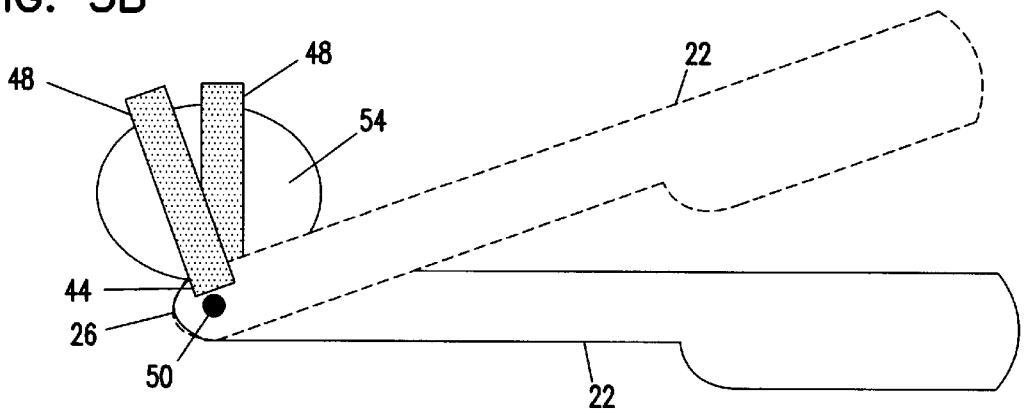
FIG. 3B is a simplified side plan view of an imaging instrument, showing rotation of the imaging sensor proximate the origin of the instrument image field.
Figure 3C:
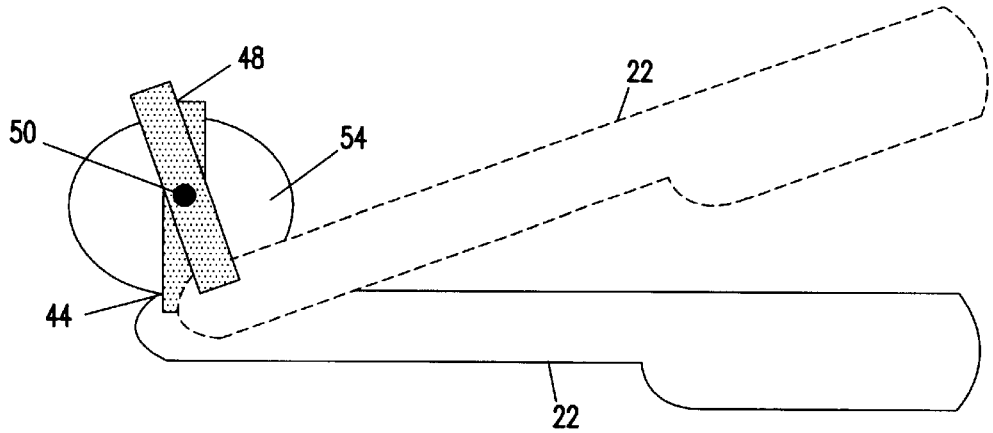
FIG. 3C is a simplified side plan view of an imaging instrument, showing rotation of the imaging sensor proximate the center of the instrument image field.

In reference now to FIGS. 3A, 3B, and 3C, simplified side plan views of an imaging instrument are shown depicting rotation of imaging sensor 22 around three different X-axes. In each figure, the instrument 22 is depicted in a first position in solid lines and then in a second position in dashed lines, and simplified target 54 is also depicted. In FIG. 3A rotation is around an X-axis through point 46, which is distal from the origin 44 of the instrument image field 48, but is proximate the center of the imaging instrument 22. In FIG. 3B, rotation of the imaging sensor 22 is around an X-axis through point 50 proximate the origin 44 of the instrument image field 48. In FIG. 3C, rotation of imaging sensor 22 is around an X-axis through point 52 proximate the center of the image field 52.

FIG. 3A shows that when the imaging instrument 22 is rotated around point 46 proximate the center of the instrument, the image field 48 not only rotates, but actually shows significant vertical translational movement. In the implementation shown, the vertical movement is enough to move image field 48 out of the stylized target zone 54. In contrast, in reference to FIG. 3B, when imaging instrument 22 is rotated around point 50 proximate tip 26 or origin 44 of image field 48, then the result is rotation of imaging field 48 within target zone 54 or near target zone 54 with less vertical and horizontal movement, or even no vertical movement, compared to rotation around point 46 in FIG. 3A. In yet other implementations of the invention, as shown in FIG. 3C, the rotation is proximate the center 33 of the imaging field 48.

Rotation around a point proximate the image origin, either near the origin such as at the center of the image field, or at the origin of the image field, can provide significant advantages. These advantages include that the image field is rotated in a more intuitive manner. For example, rotation around the X-axis through the image field can provide a more intuitive movement because the image rotates within the target, rather than moving out of the target. In particular, in the implementation shown in FIG. 3C, the image field rotates about itself, thereby providing an intuitive movement of the field.

Rotation around the points 50 and 52 are two preferred implementations of the invention, but it will be appreciated that other rotation points along the X-axis are also conceived of by the invention. For example, the rotation may be around other points intermediate the points 50 and 52, or may be around other points intermediate points 50 and 46, or may even be around center point 46 in certain embodiments. In addition, it will be appreciated that the image field 48 can vary between different imaging instruments 22 and can even vary or be adjusted in the same imaging instrument 22. Therefore, the axis of rotation is not always at the perfect center of the image field or the precise origin of the field, yet the preferred benefits of the invention are still realized because rotation is around an X-axis significantly closer to the tip of instrument 22 and preferably distal from the center 46 of instrument 22. Notably, in all preferred implementations the center of rotation around the X-axis is closer to the tip 26 of instrument 22 than to center 46 of instrument.

Figure 4A:
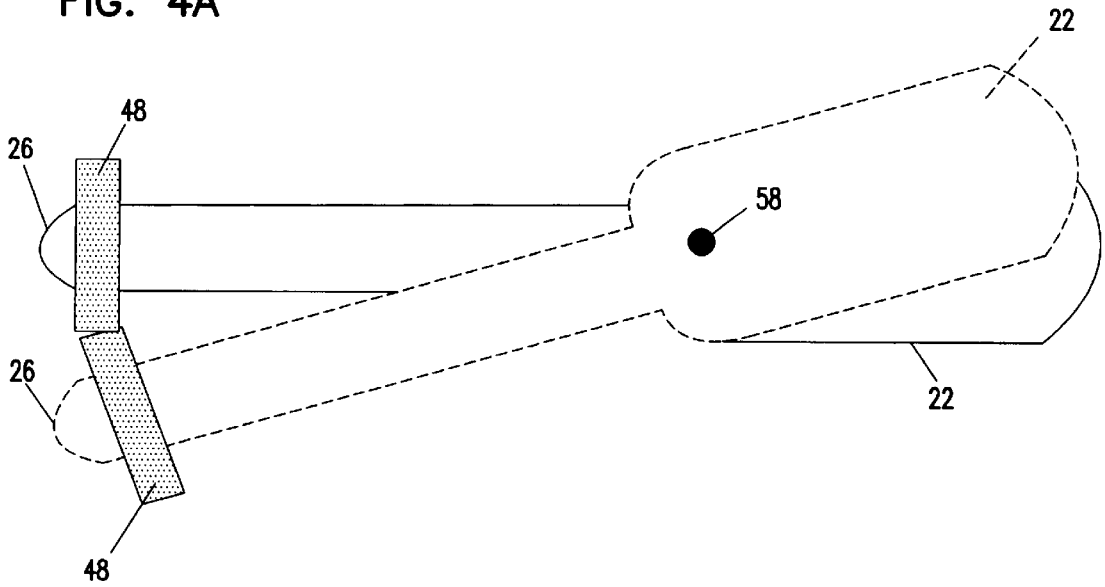
FIG. 4A is a simplified top plan view of an imaging instrument, showing rotation of the imaging sensor around an axis distal from the origin of the instrument image field.
Figure 4B:
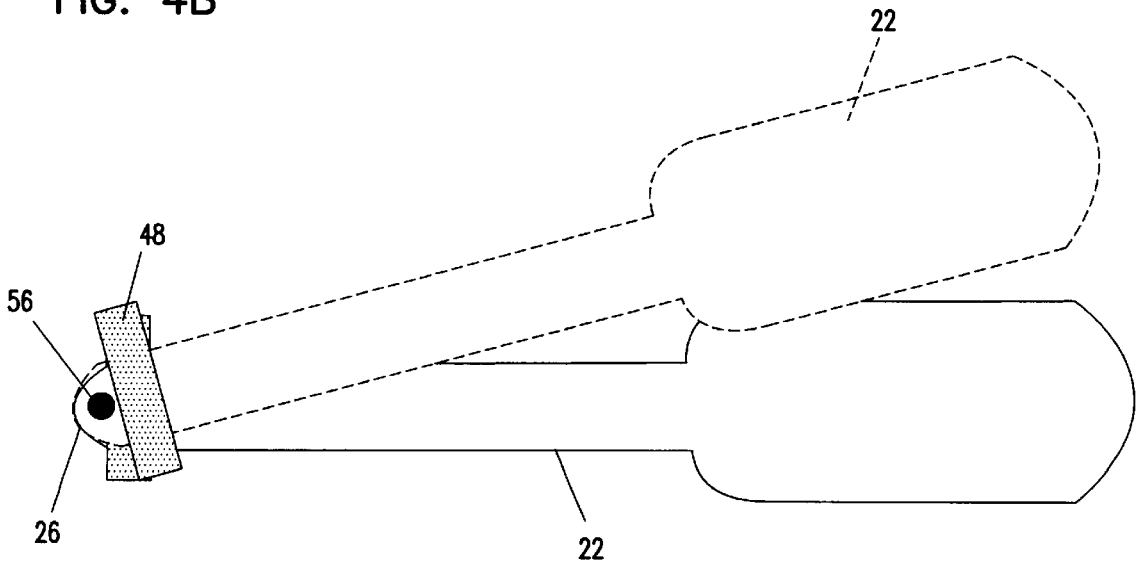
FIG. 4B is a simplified top plan view of an imaging instrument, showing rotation of the imaging sensor around an axis proximate the origin of the instrument image field.

In reference now to FIGS. 4A and 4B, top views of an imaging instrument are shown with rotation around the Z-axis (yaw). In FIG. 4A, rotation of the imaging sensor is around an axis distal from the origin of the instrument image field; while in FIG. 4B rotation of the imaging sensor around an axis proximate the origin of the instrument image field. Rotation of the imaging instrument 22 around a Z-axis 56 proximate the tip 26 rather than the center 58 provides advantages in that the imaging field 48 of the image remains substantially in one translational position but still rotates within the target (not shown).

Figure 5A:
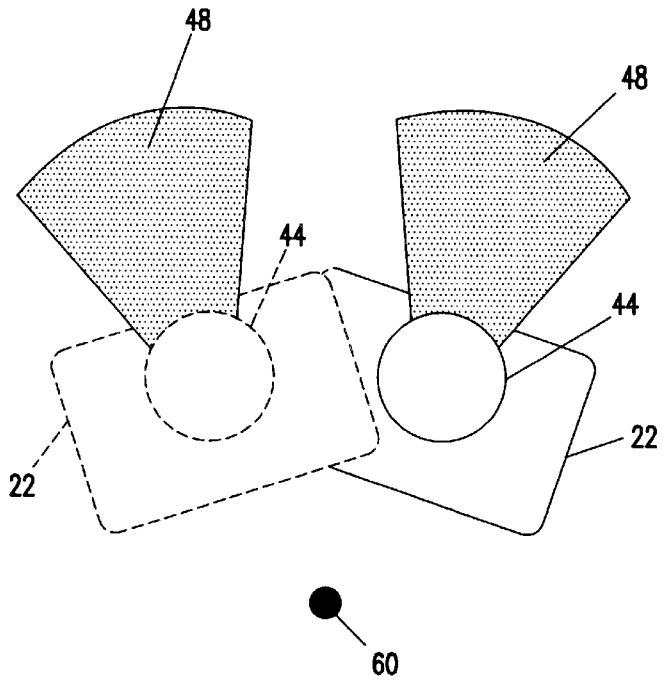
FIG. 5A is a simplified end plan view of an imaging instrument, showing rotation of the imaging sensor around an axis distal from the origin of the instrument image field.
Figure 5B:
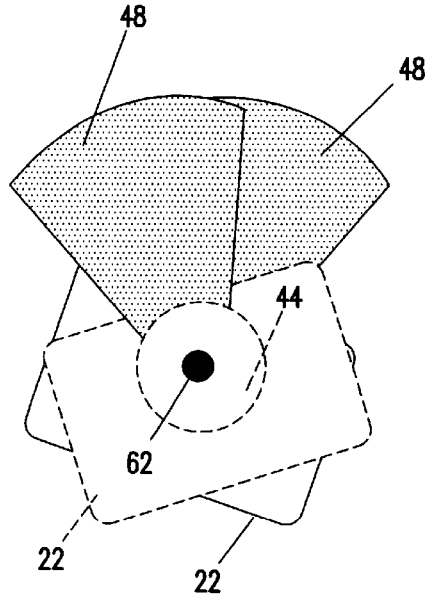
FIG. 5B is a simplified end plan view of an imaging instrument, showing rotation of the imaging sensor around an axis proximate the origin of the instrument image field.
Figure 5C:
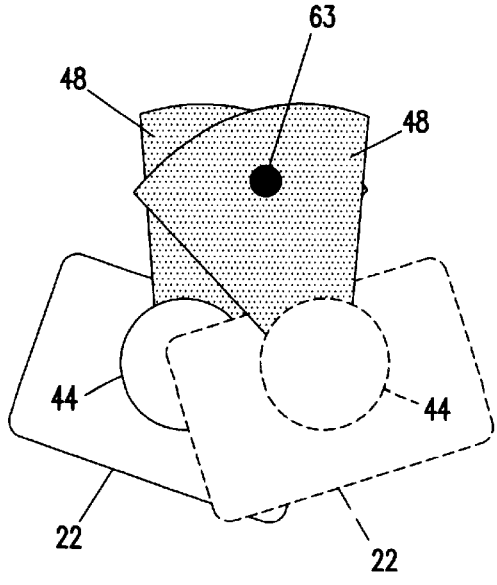
FIG. 5C is a simplified end plan view of an imaging instrument, showing rotation of the imaging sensor around an axis proximate the center of the imaging instrument field.

In reference now to FIGS. 5A, 5B and 5C, end views of imaging instrument 22 are shown with rotation around the Y-axis. In FIG. 5A, rotation of the imaging instrument 22 is around a Y-axis 60 that is distal from origin 44 of image field 48, but in FIG. 5B rotation of imaging instrument 22 is around a Y-axis 62 that is proximate origin 44 of instrument image field 48. In FIG. 5C, rotation of the imaging instrument 22 is around a Y-axis 63 that is proximate the center of the imaging field of the imaging instrument. Rotation of imaging instrument 22 around a Y-axis proximate the image field 48, or within the imaging field 48, as shown in 5B and 5C, provides the advantage that the field 48 of the image remains substantially in one translational position but still rotates within the target (not shown). In FIG. 5A, the rotation of imaging instrument 22 around point 60 creates significant translational movement of the imaging field, in addition to the rotational movement. In contrast, in FIG. 5B, the movement of the imaging field shows less translational movement. Depending upon the position of the axis, this translational movement is reduced or eliminated compared to the translational movement observed in FIG. 5A. For example, if the Y-axis travels through the tip of the imaging instrument, as shown in FIG. 5B, then the translational movement is greatly reduced relative to that shown in FIG. 5A. Alternatively, if the axis is through the approximate center of the image field 48, then the translational movement is even more reduced relative to that shown in FIG. 5A. In the preferred implementations of the invention, translation movement is substantially reduced or eliminated during rotational adjustment of the position of imaging instrument 22.

Although FIGS. 3A through 5B show specific implementations of the invention, and in particular an imaging instrument with a particular image field, the invention is suitable for use with a wide variety of imaging instruments with varying instrument configurations and image fields. For example, the image field of the depicted embodiment shows the field directed in a substantially fan shape projecting upward along the Z-axis However, other image field shapes and orientations are also useful with the present invention, such as image fields that project along the Y-axis toward or into the patient.

Figure 2:
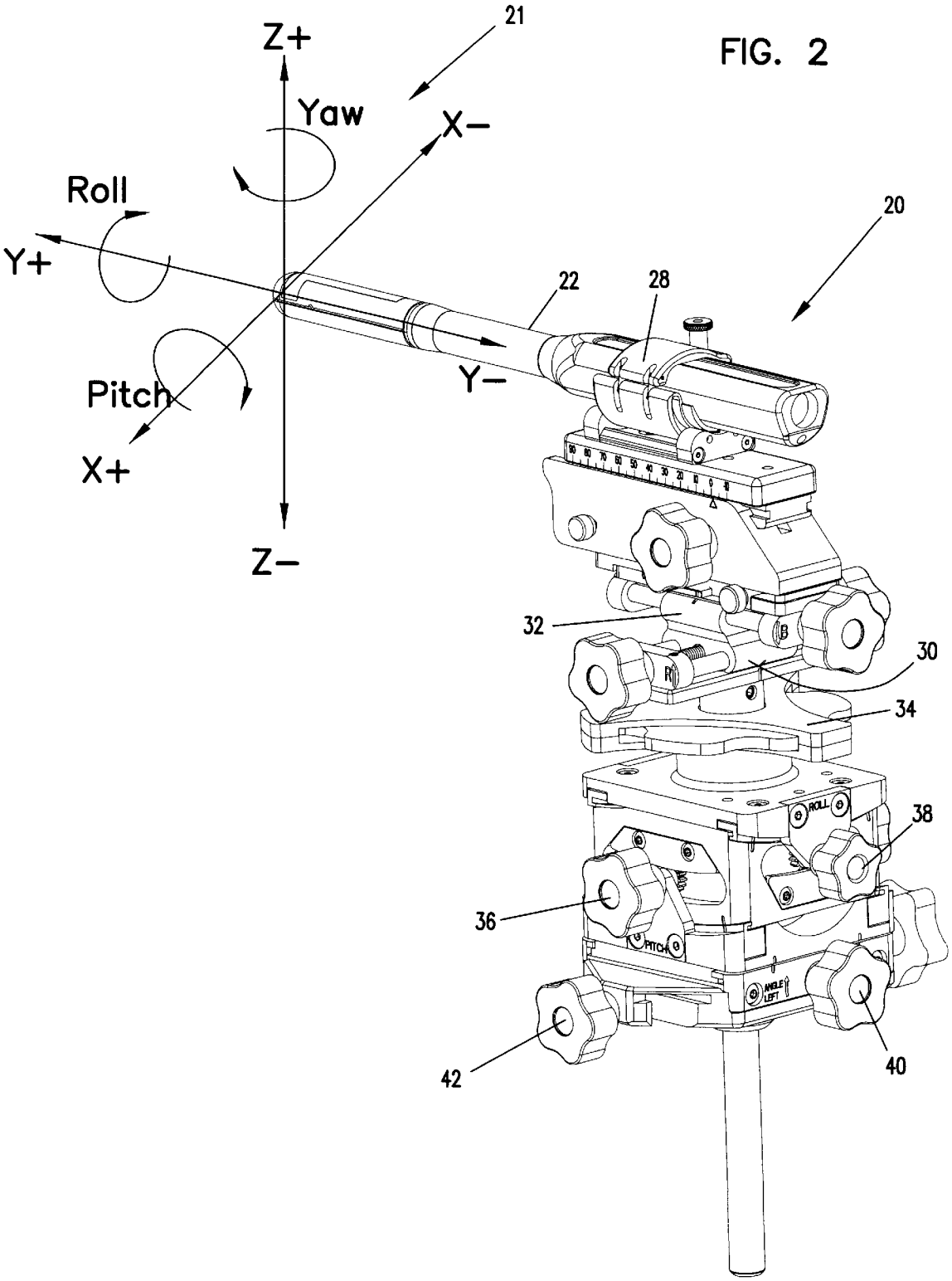
FIG. 2 is reduced scale view of the medical imaging instrument positioning device shown in FIG. 1, along with a representation of six axes of movement, including three rotational axes and three translational axes, that may be adjusted by the present invention.
Figure 6A:
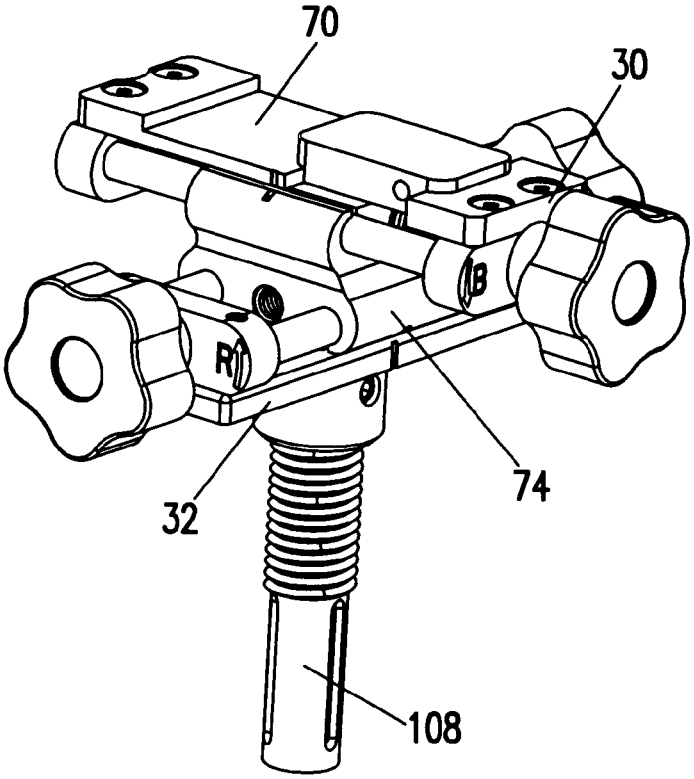
FIG. 6A is a perspective view of a portion of a medical imaging instrument positioning apparatus constructed and arranged in accordance with the present invention, the portion providing translational adjustment along the X-axis and Y-axis for the imaging instrument.
Figure 6B:
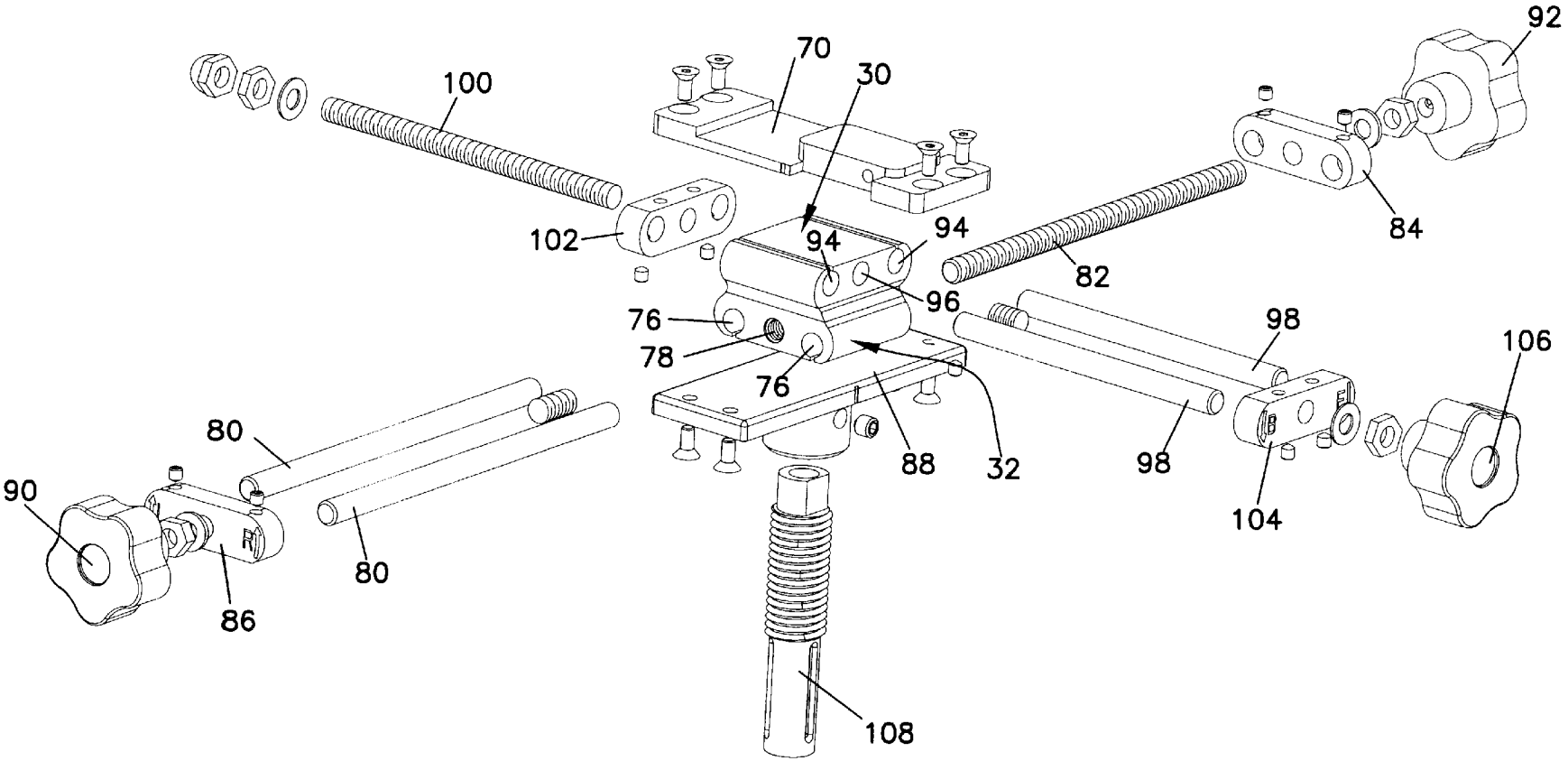
FIG. 6B is an exploded perspective view of the portion of a medical imaging instrument positioning apparatus shown in FIG. 6A.

In reference now to FIGS. 6A and 6B, X-translational mechanism 30 and a Y-axis transitional mechanism 32 from FIG. 1 are shown in more detail. FIG. 6A shows X-axis translational mechanism 30 and Y-translational mechanism 32 in assembled perspective view, and FIG. 6B shows X-translational mechanism 30 and Y-translational mechanism in exploded perspective view. As noted earlier, the embodiment shown is described for exemplary purposes only, and alternative constructions are possible to produce the inventive apparatus and results of the invention.

In the embodiment depicted in FIGS. 6A and 6B, the X and Y translational mechanisms 30, 32 are shown integrally formed with one another in a single assembly. However, in other implementations of the invention the X- and Y-translational mechanisms are independently formed as two separate assemblies. The X-and Y-translational mechanisms include an attachment base 70 onto which an imaging instrument 22 may be secured. Attachment base 70 allows for the removal of the imaging instrument 22. In addition, attachment base 70 allows for various retainers 72 (shown in FIG. 1) to be used so that a number of different types of imaging instruments may be used with one positioning apparatus 20.

A connecting block 74 provides orientation and direction of the instrument 22 relative to a patient. In the embodiment depicted, connecting block 74 is provided with a plurality of holes passing through it, including two X-axis non-threaded holes 76, and one X-axis threaded hole 78. Sliding rods 80 are configured to be placed within non-treaded holes 76, and a treaded shaft 82 is configured to be screwed into threaded hole 78. A right end cap 84 and a left end cap 86 are further included on X-axis translational mechanism 30. Right end cap 84 and left end cap 86 are secured to mounting plate 88, and also secure the ends of the sliding rods 80 and threaded shaft 82 with respect to one another.

By turning the threaded shaft 82 with either left control knob 90 or right control knob 92, the connecting block 74 can be slid along the X-axis to provide a translational adjustment to an imaging instrument secured to apparatus 20. Although not specifically described herein, it will be appreciated that various bolts, nuts, washers, screws, and other fasteners are useful in securing the parts of X-axis translational mechanism 30, including screws to secure mounting plate 88 to left end cap 86 and right end cap 84, and to secure the sliding rods 80 to left and right end caps 86, 84.

In the embodiment depicted, translational movement along the Y-axis is performed in a manner substantially similar to that along the X-axis, but with parts oriented at a 90 degree angle to the X-axis parts. Specifically, connecting block 74 includes two Y-axis non-threaded holes 94, and one Y-axis threaded hole 96. Sliding rods 98 are configured to be placed within non-threaded holes 94, and a threaded shaft 100 is configured to be screwed into threaded hole 96. A front end cap 102 and a rear end cap 104 are further included on Y-axis translational mechanism 32. Front end cap 102 and rear end cap 104 are secured to attachment base 70, and also secure the ends of the sliding rods 98 and threaded shaft 100 with respect to one another. Therefore, by turning the threaded shaft 100 with rear control knob 106, the connecting block 74 can be slid along the Y-axis to provide a translational adjustment to an imaging instrument secured to apparatus 20. Again, although not specifically described herein, it will be appreciated that various bolts, nuts, washers, screws, and other fasteners are useful in securing the parts of the Y-axis translational mechanism 32; and additional adjustment knobs may be used to control the position of the imaging instrument. Also shown in FIG. 6 is a positioning pole 108, which is secured to mounting plate 88.

Figure 7A:
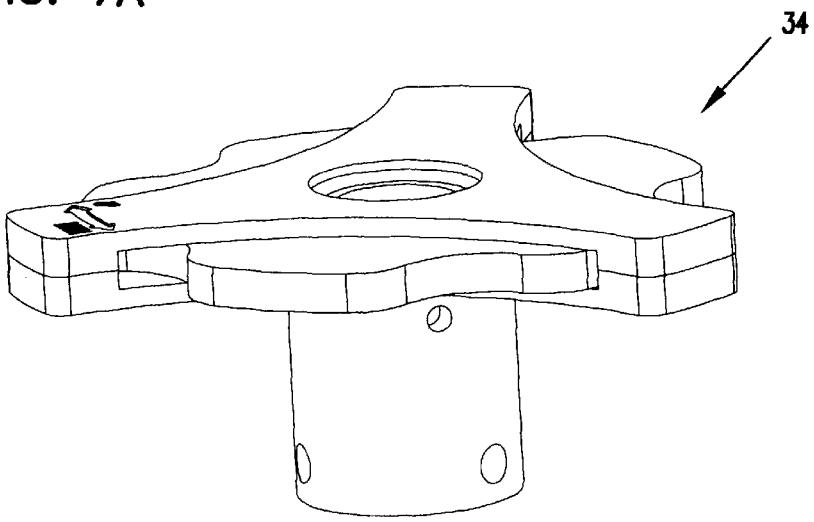
FIG. 7A is a perspective view of a portion of a medical imaging instrument positioning apparatus constructed and arranged in accordance with the present invention, the portion providing translational adjustment along the Z-axis for the imaging instrument.
Figure 7B:
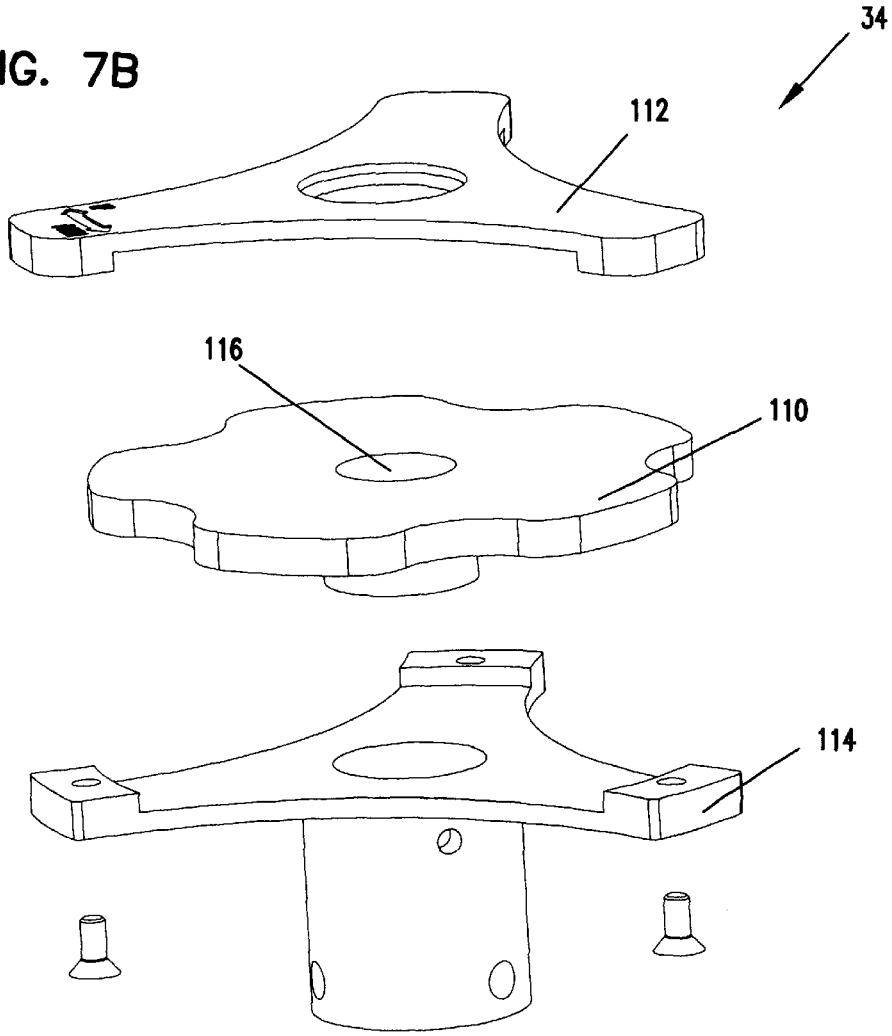
FIG. 7B is an exploded perspective view of the portion of the medical imaging instrument positioning apparatus shown in FIG. 7A.

The Z-axis translational mechanism 34 is illustrated in FIGS. 7A and 7B, showing the mechanism 34 in assembled and exploded views, respectively. Z-axis translational mechanism 34 provides movement of the imaging instrument 22 along the Z-axis, preferably with little or no movement in the X-axis or Y-axis, and preferably without any rotational movement. Z-axis translational mechanism 34 includes a center rotational disk 10 positioned intermediate a top plate 112 and a bottom plate 114. Center rotational disk 110 includes a threaded center opening 116 containing threads to mesh with the threads of the positioning pole 108. It will be noted that positioning pole 108 interlocks with bottom plate 114 and the remainder of apparatus 20 so that it does not rotate, but instead can travel translationally along the Z-axis without turning. By rotation of the center rotational disk 110, the positioning pole 108 is lifted or lowered, thereby altering the elevation of the imaging instrument 22 (not shown) and providing translational movement of imaging instrument 22 along the Z-axis (raising or lowering the imaging instrument).

Figure 8:
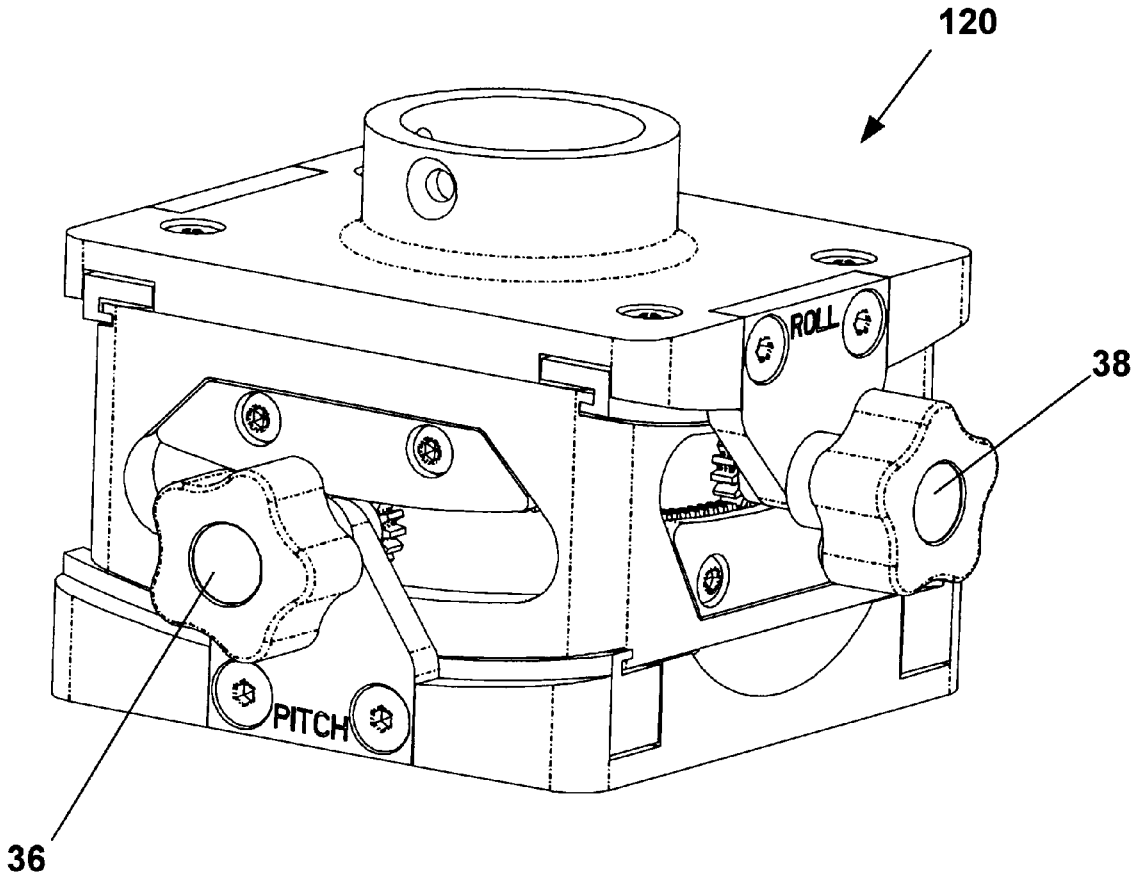
FIG. 8 is a perspective view of a portion of a medical imaging instrument positioning apparatus constructed and arranged in accordance with the present invention, the portion providing rotational adjustment of the imaging instrument around the X-axis (pitch) and rotational adjustment of the imaging instrument around the Y-axis (roll).
Figure 9:
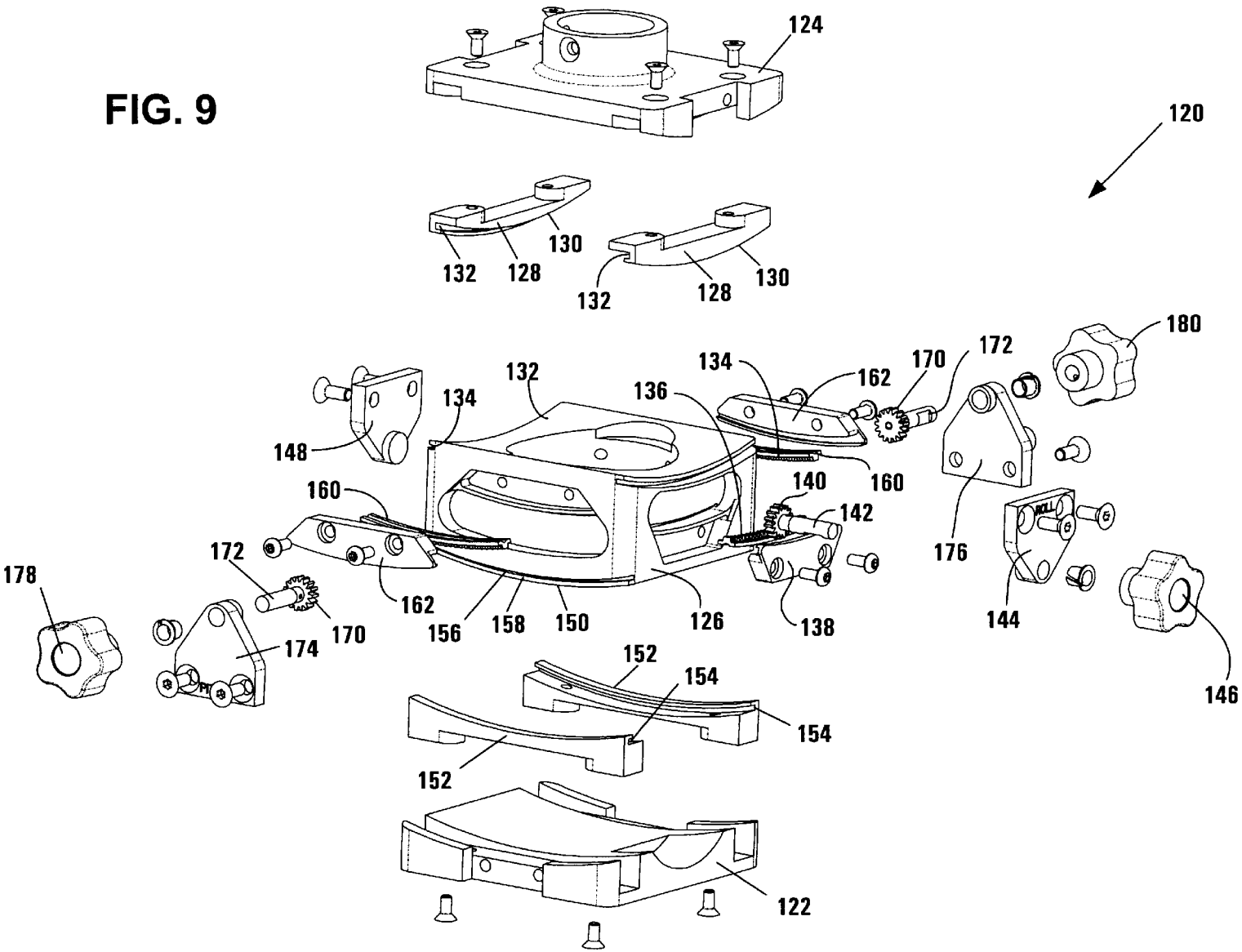
FIG. 9 is an exploded perspective view of the portion of the medical imaging instrument positioning apparatus shown in FIG. 8.

In reference now to FIGS. 8 and 9, a two-dimensional rotational assembly 120 is depicted in perspective and exploded views, respectively. The two-dimensional rotational assembly 120 controls the pitch and roll of the imaging instrument. As used herein, pitch is defined as the rotation of the imaging instrument around a X-axis; and roll is defined as the rotation of the imaging instrument around a Y-axis. Rotational assembly 120 allows adjustments in the pitch of the imaging instrument, and preferably allows rotation about an X-axis that runs through the imaging field, or proximate the imaging field (as shown, for example, in FIGS. 3B and 3C) Rotational assembly 120 also allows adjustments in the roll of the imaging instrument 22 around the Y-axis that preferably runs through the imaging field or proximate the imaging field (as shown, for example, in FIG. 5B).

Although rotational assembly 120 allows for adjustment in both pitch and roll, the invention is not limited to apparatus' that always have combined pitch and roll assemblies, or that are exclusively pitch and roll assemblies. Thus, the pitch and roll elements can be separated to individually control pitch or roll. Alternatively, the apparatus 20 of the invention can be constructed so as to adjust pitch but not roll, or roll but not pitch. Also alternatively, the apparatus may be constructed such that one of the pitch or roll adjustments is along an axis through the imaging field of the imaging instrument, but the other axis is not.

In reference now to the particular aspects of the specific exemplary rotational assembly 120 shown in FIG. 9, the rotational assembly 120 includes both X-axis rotational mechanism 36 and Y-axis rotational mechanism 38. X-axis rotational mechanism 36 includes a bottom plate 122, a top plate 124, and a center block 126. Top plate 124 is configured to securely attach to the bottom plate 114 of the Z-axis translational mechanism (shown in FIG. 7B). Two rails 128 are secured to, or are integrally formed with, top plate 124. These rails 128 are configured with arcuate surfaces 130 that are configured to slide along a similarly arcuate top surface 132 of the center block 126. Rails 128 include grooves 132 that interlock with tongues 134 formed into the side of the center block 126. By interlocking the grooves 132 and tongues 134, the top plate 124 of the rotational assembly 120 is kept together and prevented from lifting apart. However, as indicated in the figures, the rails 128 are preferably detachable from the top plate 124 so that the apparatus 120 can be disassembled for maintenance, repair, or retrofitting.

The curved surfaces 130 of rails 128 and curved surface 132 of center block 126 combine to define a track on which the roll of the imaging instrument 22 (not shown) may be adjusted. Rails 128 are preferably moved along the center block 126 by a gear and rack system. In the illustrated embodiment, rack 136 is secured to the center block 126 by retainer 138. A gear 140 and gear shaft 142 are positioned so that the gear 140 meshes with the rack 136. Gear shaft 142 passes through back end cap 144 and is connected to a control knob 146. Back end cap 144 is also secured to the top plate 124. On an opposite side of the top plate 124 a front end cap 148 is secured, and this front end cap 148 helps hold top plate 124 securely to the center block 126, while still allowing travel of top plate 124 along the curved surface 132 of the center block 126. Rotation of control knob 146 causes the gear 140 to apply a force to the rack 136 resulting in movement of the top plate 124 on rails 128 along the curved top surface 132 of the center block 126. Said movement results in rolling rotation of the imaging instrument around a Y-axis. In specific implementations, two knobs are used to cause the gear 140 to apply a force to the rack 136.

Similarly, other components of the rotational assembly 120 preferably use a gear and rack system to provide changes in pitch of the imaging instrument. In the embodiment depicted, the center block 126 includes a curved bottom surface 150 that is configured to slide along, and interlock with, curved bottom rails 152. Bottom rails 152 also include grooves 154 configured to interlock with tongues 156 proximate the bottom surface 158 of the center block 126.

Racks 160 are secured to the center block 126 by retainers 162, or alternatively are integrally formed or milled from the center block 126. Having two racks (and gears and control knobs) on opposite sides of the center block 126 allows for adjustment of the pitch of the imaging instrument from either side of the apparatus 22. However, in alternative implementations, the apparatus includes only one rack, gear, and control knob. Gears 170 and gear shafts 172 mesh with racks 160 and are held in place by left end cap 174 and right end cap 176, respectively. Rotation of left control knob 178 or right control knob 180 rotates the gears, thereby providing a force that rotates center block 126 along the curved surface of bottom plate 122, causing rotation of the top plate 124 around the X-axis. This rotation around the X-axis simultaneously rotates the imaging instrument, and consequently the imaging field around the X-axis.

Figure 10:
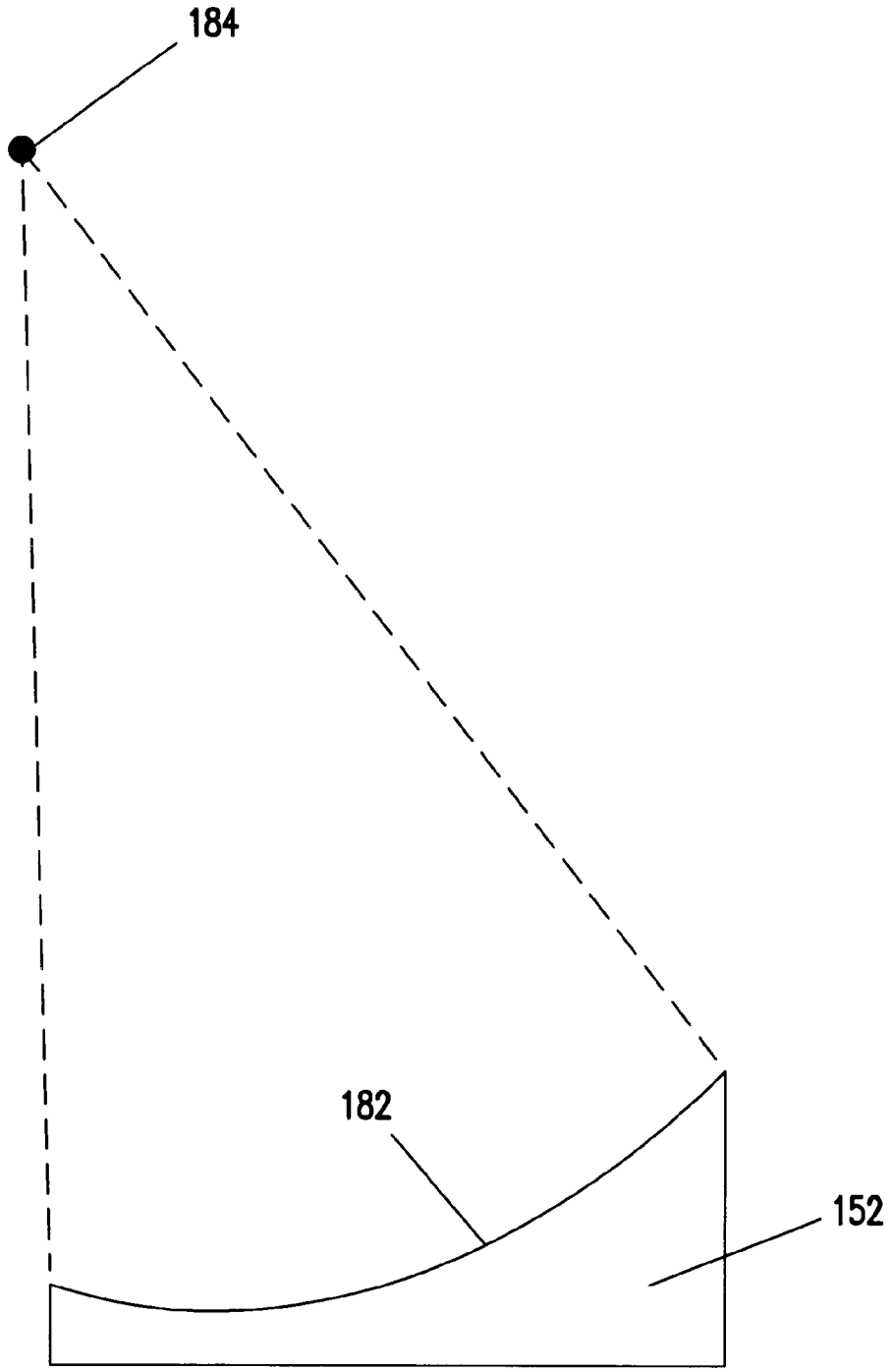
FIG. 10 is a diagram depicting the arrangement of curved surfaces of an implementation of the present invention.

The X-axis around which the imaging instrument rotates is preferably through the imaging field. In certain such implementations, rails 152 are preferably configured in an arcuate manner having radii converging at a point within the imaging field. In reference now to FIG. 10, a stylized view of such a rail 152 is shown. The curved top surface 182 is oriented toward the axis 184. The incline of the curve allows for positioning the axis 184 away from directly above the positioning assembly.

Figure 11A:
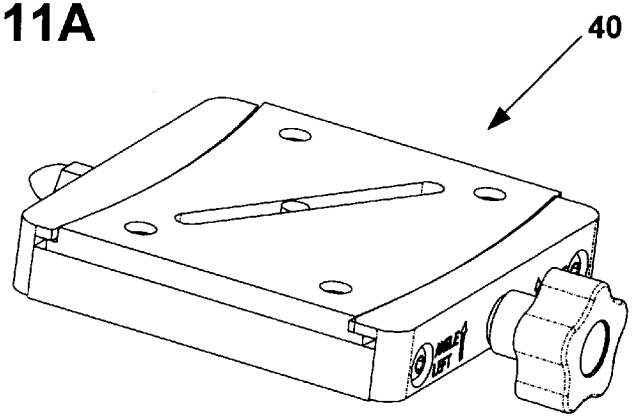
FIG. 11A is a perspective view of a portion of the medical imaging instrument of the present invention providing rotational adjustment of the imaging instrument around the Z-axis (yaw).
Figure 11B:
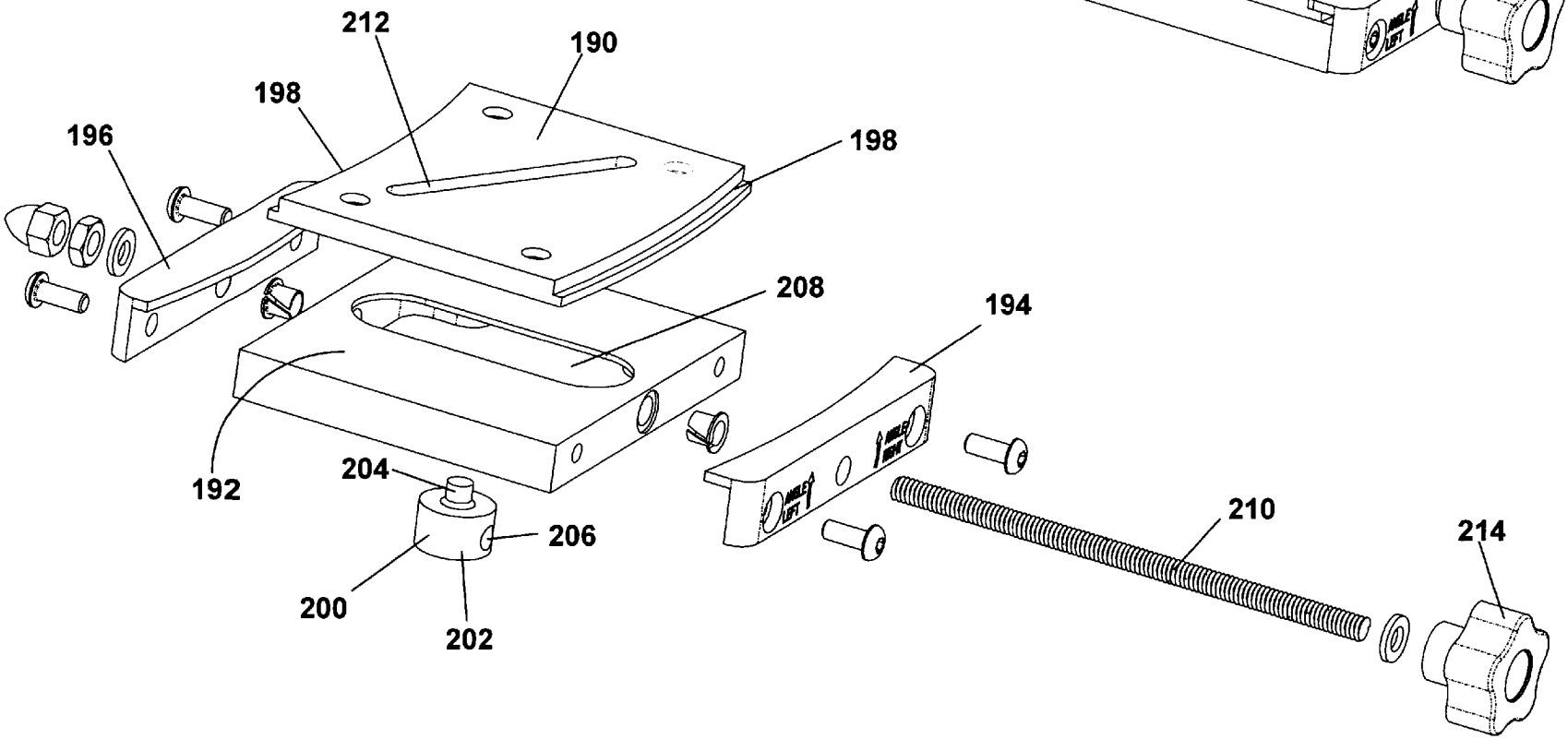
FIG. 11B is an exploded perspective view of the portion of the medical imaging instrument positioning apparatus shown in FIG. 10A.

In reference now to FIGS. 11A and 11B, a Z-axis rotational assembly 40 is depicted in assembled and exploded views, respectively. Z-axis rotational assembly 40 provides rotational adjustments around the Z-axis. Such adjustments are also known as "yaw" of the imaging instrument. Rotational assembly 40 includes a top plate 190 and a center block 192, along with curved retainer caps 194 and 196 that secure top plate 190 to the center block 192 by way of lips 198. A sliding block 200 having a body 202, an upper pin 204, and threaded hole 206 is positioned in the interior of the center block 192 in a first slot 208. A threaded shaft 210 feeds through the two curved retainer caps 194, 196, as well as the threaded hole 206 of the sliding block 200.

Rotation of threaded shaft 210 using knob 214 provides advancement of the sliding block 200 within the first slot 208. This advancement causes the pin 204 of the sliding block 200 to slide along a second slot 212 that is positioned in the top plate 190. The second slot 212 in the top plate 190 is preferably arranged diagonally to the first slot in the center block. As the body 202 travels along the first slot 208 in the center block 192, the top plate 190 rotates along the curved surfaces of retainer caps 194 and 196 as the pin 204 in the sliding block 200 moves along the diagonal second slot 212. This rotation provides a yaw adjustment of the imaging instrument, preferably along a Z-axis running through the center of the imaging field.

Figure 12A:
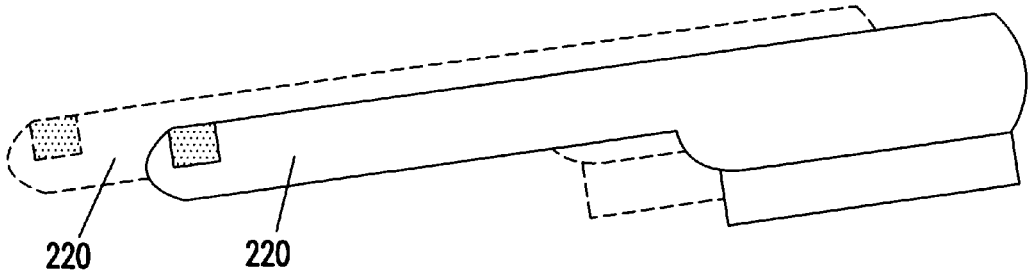
FIG. 12A is a simplified side plan view of an imaging instrument, showing approximate movement of the imaging sensor when a translational mechanism of the invention is placed below a rotational mechanism of the invention.
Figure 12B:
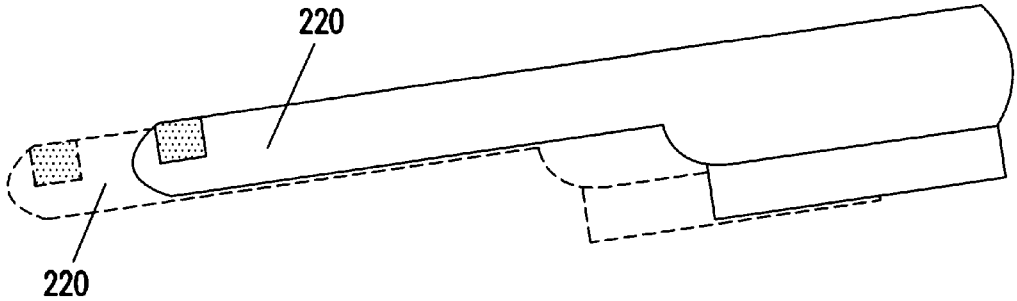
FIG. 12B is a simplified side plan view of an imaging instrument, showing approximate movement of the imaging sensor when a translational mechanism of the invention is placed above a rotational mechanism of the invention.

In the embodiment depicted above, the X, Y and Z-translational controls are shown placed above the rotational controls. However, it will be appreciated that alternatively the X-, Y-, and Z-translational controls may be placed below the rotational controls. By placing the X-, Y-, and Z-translational controls above the rotational controls, translational movement can be made along the rotated X, Y, and Z-axes corresponding to the imaging probe. This improvement is shown in FIG. 12*a* and 12*b*, which show an imaging instrument 220 moved along a path in which the translational controls are placed respectively below, and above, the rotational controls. In FIG. 12*a*, the significance of having the translational controls placed below the rotational controls is shown. For example, adjustment along the Y-axis results in the tilted probe 220 traveling horizontally, but the movement is not along the center of the probe 220 In contrast, in FIG. 12*b* the translational controls are placed above the rotational controls, resulting in the translational controls being rotated along with the probe 220. Therefore, in FIG. 12*b*, the movement along the Y-axis follows along the center of the prove 220 (along a line running from the tip of the probe to its opposite end). Similar characteristics can be observed with the X-axis and Z-axis.

The invention is advantageous in that the described embodiment allows easy adjustment in the position of the imaging instrument, and in particular the imaging field of the imaging instrument. This movement is relatively intuitive because each adjustment, whether translational or rotational, can preferably be made with a single control. For example, if only rotation of the imaging field is desired, without significant translational movement, then such rotation can easily be made. Similarly, if translational movement is desired with little or no rotational movement, then such movement can easily be made.

We claim:

1. An apparatus for adjusting the position of an imaging instrument, the apparatus comprising:

a) a manually controlled mechanism for providing translational movement along three axes; and b) a manually controlled mechanism for providing rotational movement around three axes;

wherein the apparatus is configured for rotational movement around at least one axis that is proximate with the area of the instrument's image field.

2. The apparatus according to claim 1, wherein the mechanism for providing translational movement is positioned above the mechanism for providing rotational movement.

3. The apparatus according to claim 1, wherein the mechanism for providing translational movement is positioned below the mechanism for providing rotational movement.

4. The apparatus according to claim 1, wherein the rotational movement around at least two axes is proximate with the area of the instrument's image field.

5. The apparatus according to claim 1, wherein the mechanism for providing translational movement along three axes includes movement of a portion of the mechanism along a threaded rod.

6. The apparatus according to claim 1, wherein the mechanism for providing rotational movement around three axis includes a gear and a rack.

7. An apparatus for adjusting the position of a imaging instrument, the apparatus providing:

a) manually controlled translational adjustments along three axis; and b) manually controlled rotational adjustments around three axis;

wherein the apparatus is configured such that when an imaging instrument is positioned on the apparatus, at least one axis of the axes of rotational adjustment is through the imaging field of the imaging instrument.

8. The apparatus according to claim 7, wherein the each of the translational adjustments and rotational adjustments may be made independent of one another.

9. An apparatus for adjusting the position of an imaging instrument, the apparatus comprising:

a manually controlled imaging instrument having an approximate imaging origin and an approximate instrument center;

wherein the apparatus permits the rotational movement of the imaging instrument around at least one axis proximate the imaging origin.

10. The apparatus according to claim 9, wherein the apparatus permits the rotational movement of the imaging instrument around at least two axes located proximate the imaging origin.

11. The apparatus according to claim 10 wherein the apparatus permits the rotational movement of the imaging instrument around three axes located proximate the imaging origin.

12. The apparatus according to claim 10, wherein the rotational movement around at least two axes is proximate with the area of the instrument's image field.

13. The apparatus according to claim 10, wherein mechanism for providing translational movement along three axes includes movement of a portion of the mechanism along a threaded rod.

14. An apparatus for adjusting the position of an imaging instrument, the apparatus comprising:

an arrangement for retaining an imaging instrument such that the imaging instrument has an imaging origin and an apparatus origin;

wherein the apparatus permits the manually controlled rotational adjustment of the imaging instrument around at least two axis that are positioned intermediate the imaging origin and the apparatus origin.

15. The apparatus according to claim 14, wherein the each of the rotational adjustments may be made independent of one another.

16. The apparatus according to claim 14, wherein the apparatus permits the rotational adjustment of the imaging instrument around at least two axis that are positioned intermediate the imaging origin and the apparatus origin proximate the imaging origin.

17. The apparatus according to claim 14, wherein the arrangement for retaining an imaging instrument includes an integrally retained imaging instrument.

18. The apparatus according to claim 14, wherein the apparatus further permits translational adjustment of the imaging instrument along at least two axes.

* * * * *